US006250730B1

(12) United States Patent
Roth et al.

(10) Patent No.: US 6,250,730 B1
(45) Date of Patent: Jun. 26, 2001

(54) SAFETY DEVICE FOR DRAWERS

(75) Inventors: Jonathan Roth, Pardes-Hana; Isaac Oren, Herzelya, both of (IL)

(73) Assignee: Shilav, Bnei-Braq (IL)

( * ) Notice: Subject to any disclaimer, the term of this patent is extended or adjusted under 35 U.S.C. 154(b) by 0 days.

(21) Appl. No.: 09/398,653

(22) Filed: Sep. 17, 1999

(30) Foreign Application Priority Data

Sep. 17, 1998 (IL) ..... 126297

(51) Int. Cl.[7] ..... A47B 88/16
(52) U.S. Cl. ..... 312/333; 312/334.44
(58) Field of Search ..... 312/333, 330.1, 312/334.44, 334.46, 334.47, 334.4, 334.7, 334.8, 334.17, 350; 292/87

(56) References Cited

U.S. PATENT DOCUMENTS

| | | | | |
|---|---|---|---|---|
| 449,482 | * | 3/1891 | Levy | 312/334.47 X |
| 524,225 | * | 8/1894 | Smith | 312/334.44 X |
| 850,649 | * | 4/1907 | Huntington | 312/334.44 X |
| 919,682 | * | 4/1909 | Bertram | 312/334.44 X |
| 922,852 | * | 5/1909 | Cannan | 312/333 |
| 1,295,186 | * | 2/1919 | Miller | 312/334.46 |
| 2,730,423 | * | 1/1956 | Mock | 312/334.46 X |
| 2,731,321 | * | 1/1956 | Thompson | 312/334.46 |
| 4,505,526 | | 3/1985 | Leck | 312/333 |
| 4,632,438 | | 12/1986 | McKinney | 292/87 |
| 4,717,184 | | 1/1988 | Boyce | 292/87 |
| 5,344,002 | | 9/1994 | Baczkowski . | |
| 5,626,372 | | 5/1997 | Vogt | 292/87 |
| 5,645,307 | | 7/1997 | Wengler | 294/157 |
| 5,709,517 | | 1/1998 | Steckel et al. . | |
| 5,795,044 | | 8/1998 | Trewhella, Jr. et al. | 312/333 |

FOREIGN PATENT DOCUMENTS

| | | | | |
|---|---|---|---|---|
| 2019668 | * | 11/1971 | (DE) | 312/334.44 |
| 620113 | * | 3/1949 | (GB) | 312/334.44 |

* cited by examiner

*Primary Examiner*—James O. Hansen
(74) *Attorney, Agent, or Firm*—Kenyon & Kenyon

(57) ABSTRACT

A safety device for a sliding assembly comprising a housing and one or more drawers mounted within the housing and slidable between open and closed positions. The safety device comprises a stopping member for fixing to a side wall of the housing adjacent a front edge thereof, and an obstructing member for fixing to a corresponding side of the drawer adjacent a front edge thereof. The stopping member is formed with a stopper wall, and the obstructing member is formed with a corresponding obstruction wall.

14 Claims, 9 Drawing Sheets

FIG.3A
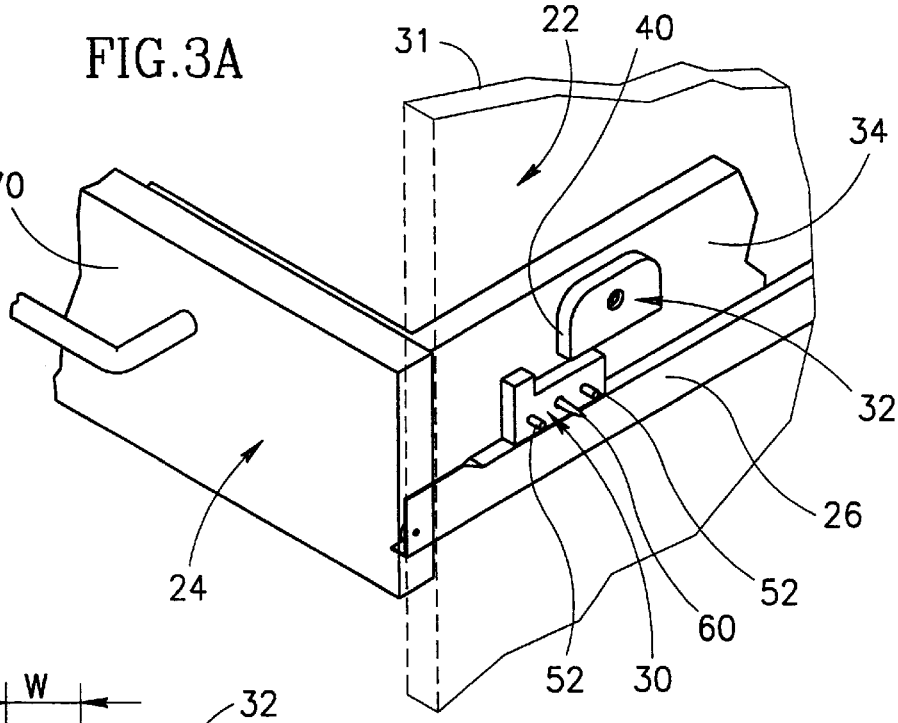
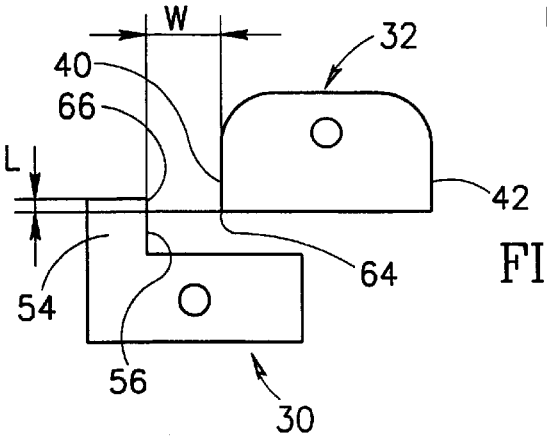
FIG.3B
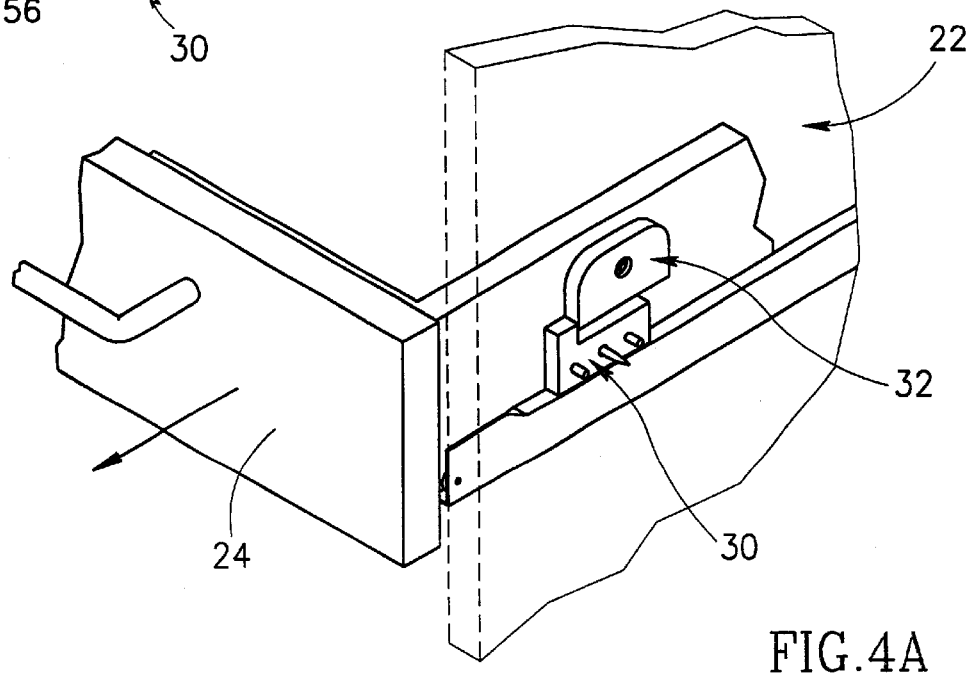
FIG.4A

SAFETY DEVICE FOR DRAWERS

FIELD OF THIS INVENTION

The present invention is in the field of safety devices for drawer-like elements and in particular it is directed to devices for preventing injuries and hazardous situations to which children are typically exposed by drawers. The safety device with which the present invention is concerned is also directed to devices adapted for preventing spontaneous opening of drawer-like member upon tilting.

BACKGROUND OF THE INVENTION

The terms "drawer" and "drawer-like member" as interchangeably used herein in this specification and claims denote a drawer, shelf, container, etc. which is slidably mounted within a housing and wherein sliding is effected by rails, telescopic rails, rollers or other means, as known per se.

Drawers are common articles in daily life, e.g. in kitchens, children's rooms, office desks, chests of drawers, etc. and in use, they constitute a hazardous situation for user's fingers, and at times may cause unpleasant injuries, in particular when children are involved. Even more so, a child may attempt to climb or enter into an open drawer which may cause overturning of the chest of drawers or the like, which might be a fatal accident.

A variety of safety devices have been provided for drawers in order to obviate the above-mentioned dangers. For example, U.S. Pat. Nos. 4,505,526, 4,632,438, 5,626,372, 5,645,307, 5,709,517 and 5,795,044, are all directed to safety devices suitable for preventing opening of a drawer prior to manipulating a locking latch. However, disengaging the locking latch requires at times some high performance manipulation. In addition, these devices do not provide any safety in closing of a drawer.

U.S. Pat. Nos. 4,717,184 and 5,344,002 do provide safety both in opening and closing of a drawer and manipulating a locking latch is required. However, the safety means disclosed in these patents are of considerable sophistication and are thus expensive, less reliable owing to possible failure of mechanical components and are also expensive.

A different aspect involved with drawer-like elements is concerned with utility vehicles and the like, e.g. different types of military or terrain vehicles wherein equipment is at times stored in slidable drawer-like containers. However, such containers are likely to spontaneously open or close each time the vehicle tuns. Such spontaneous displacement may be both hazardous to personnel and may cause damage to equipment. For that purpose, some special latches and locking means are provided which, under tough conditions may be difficult to handle.

It is an object of the present invention to provide a novel safety device for drawer-like elements in which the above-referred to disadvantages are significantly reduced or overcome.

SUMMARY OF THE INVENTION

According to the present invention there is provided a safety device for a assembly comprising a housing and one or more drawer-like members mounted within said housing and slidable between open and closed positions;

where said drawer-like member also having some vertical tolerance within the housing;

the safety device comprising a stopping member for fixing to a side wall of the housing adjacent a front edge thereof; and an obstructing member for fixing to a corresponding side of the drawer-like member adjacent a front edge thereof;

the stopping member being formed with a stopper wall, and the obstructing member being formed with corresponding a obstruction wall;

the arrangement being such that in the closed position, the bottom edge of the obstruction wall extends bellow a top edge of the stopping wall and there exists a vertical distance between a bottom edge of the obstruction wall and a top edge of the stopper wall; said distance being less than the vertical tolerance; whereby the sliding the drawer-like element is obstructed.

Preferably, each drawer-like member is fitted at each side thereof with a safety device according to the invention.

The device in accordance with the present invention is directed to avoid finger injury, in particular for young users, i.e. children. Accordingly, at the closed position of the drawer-like member, the top edge of the stopper wall is nearer a front edge of the drawer-like member than the bottom edge of the obstruction wall. In accordance with this arrangement, the front panel of the drawer has to be slightly lifted and only then it may be pulled outwardly, so that the obstructing member overrides the stopping member.

By a preferred application, the stopper wall and the obstruction wall are essentially parallel and are preferably essentially vertical.

By a still a preferred embodiment the stopping member is formed with an auxiliary stopper wall and the obstructing member is formed with a corresponding auxiliary obstruction wall; where at the closed position, the bottom edge of the auxiliary obstruction wall extends bellow a top edge of the auxiliary stopping wall and there exists a vertical distance between a bottom edge of the auxiliary obstruction wall and a top edge of the auxiliary stopper wall; said distance being less than the vertical tolerance.

According to this arrangement, closing a drawer is obstructed as well whereby upon sliding the drawer into a closed position is obstructed near to its closed position and it is necessary to slightly lift the drawer in order to overcome the obstruction.

In accordance with one application, the safety device is fitted for installation within an interstice formed within a side wall of the drawer-like member and the side wall of the housing, in particular when the drawer-like member is slidable over rails or telescopic rails.

By another application, where side walls of the drawer-like member are essentially flush with side walls of the housing, the obstructing member is fixed at a bottom side edge of the drawer-like member.

By another embodiment of the invention, the safety device enables free displacing of the drawer-like member into either the closed or open position whereby displacing in the other one of the closed or open position is restricted. For that purpose at least one of the stopper wall and the corresponding obstruction wall and a corresponding one or both of the auxiliary stopper wall and the auxiliary obstruction wall are sloped.

In accordance with still a specific embodiment of the present invention the safety device is designed so as to allow the components to remain attached within the respective side walls without constituting an obstacle. This situation is desirable in order to avoid losing the components of the locking when the device is not in use. Accordingly, rotating one or both of the stopping member and the obstructing member by 180° about a fastener fixing them to the side wall of the respective housing and the drawer-like member, results in that the drawer-like element is freely slidable within the housing.

Preferably, in order to facilitate easy assembly of the safety device to the side walls of the respective housing or drawer-like member, one or both of the stopping member and the obstructing member are formed with one or both of vertical and horizontal slots so as to allow accurate positioning by a fastener extending therethrough.

In accordance with one specific embodiment, the horizontal distance between the bottom edge of the obstruction wall and the top edge of the stopping wall is at least similar to the thickness of a front wall of the drawer like member.

In accordance with another aspect of the present invention there is provided a safety kit for a sliding assembly comprising a housing and one or more drawer-like members mounted within said housing and slidable between open and closed positions; said drawer-like member also having some vertical clearance;

the safety kit comprising a stopping member for fixing to a side wall of the housing adjacent a front edge thereof; and an obstructing member for fixing to a corresponding side of the drawer-like member adjacent a front edge thereof;

the stopping member being formed with a stopper wall and the obstructing member being formed with corresponding a obstruction wall.

In accordance with the second aspect of the present invention there is also provided a positioning jig for correct positioning of the stopping member and the obstructing member on the respective drawer-like member and housing side wall.

BRIEF DESCRIPTION OF THE DRAWINGS

In order to understand the invention and to see how it may be carried out in practice, some preferred embodiments will now be described, by way of example only, with reference to the accompanying drawings, in which:

FIG. 2 is a perspective exploded view of a safety device in accordance with the present invention wherein:

FIG. 3A is a sectional perspective view of a safety device mounted on a sliding unit, shown in the closed position;

FIG. 3B is a schematic presentation of the safety device in a closed position;

FIGS. 4A–3D are consecutive steps of opening and closing a drawer fitted with a safety device in accordance with the present invention;

DETAILED DESCRIPTION OF A PREFERRED EMBODIMENT

Figure 1:
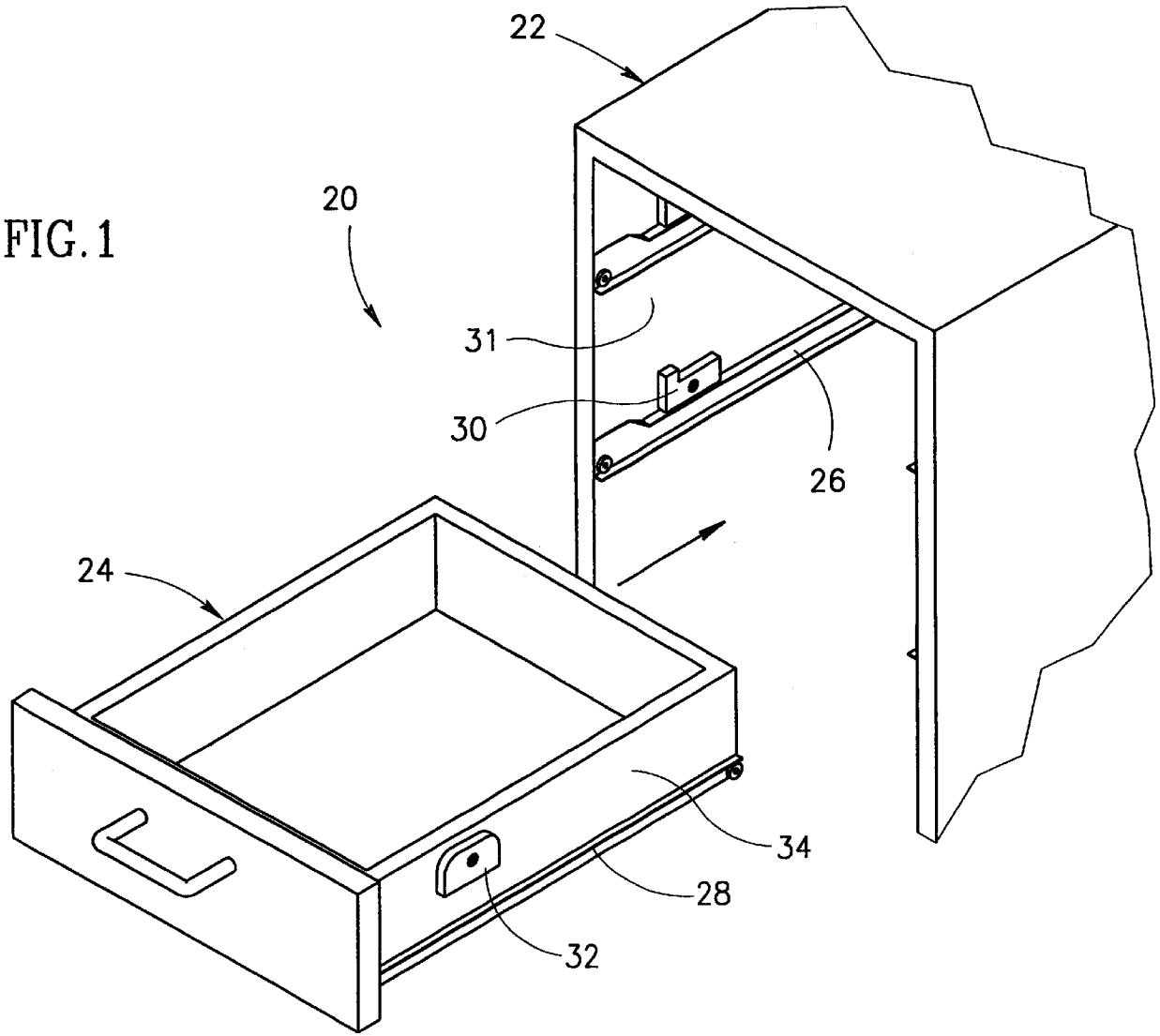
FIG. 1 is a perspective view of a sliding assembly comprising a housing and a drawer, the assembly being fitted with a safety device in accordance with the present invention.

Attention is first directed to FIG. 1 of the drawings showing a section of a sliding assembly generally designated 20 comprising a housing 22 and a plurality of drawers, only one of which is shown, and is designated 24.

Drawer 24 is slidably received within housing 22 by means of a telescopic rail assembly of each side thereof, comprising a housing rail component 26 and a drawer rail component 28, as known per se, for sliding displacement of drawer 24 between open and closed positions, all as known in the art.

The safety device in accordance with the present invention comprises a stopping member generally designated 30 attached above railing 26 to a side wall 31 of housing 22 and a corresponding obstructing member generally 32 fixed above rail 28 to side walls 34 of drawer 24.

It is known that drawer assemblies of the illustrated type have some vertical tolerance, typically of several millimeters, owing to manufacture and assembly tolerance of the rails.

Preferably, each drawer is fitted with two safety devices one at each side. However, for practical reasons, there is seen in FIG. 1 a stopping member 30 at one side and an obstructing member 32 at an opposite side, as the artisan will appreciate.

Stopping member 30 and obstructing member 32 are fixed to the corresponding side wall by means of through-going screws and are preferably secured by press-fit studs as will become apparent hereinafter with reference to FIGS. 2A and 2B.

As further noted in FIG. 1, the thickness of stopping member 30 and obstructing member 32 does not exceed the width of rail members 26 and 28 so as to avoid interference with smooth sliding operation of drawer 24.

Figure 2A:
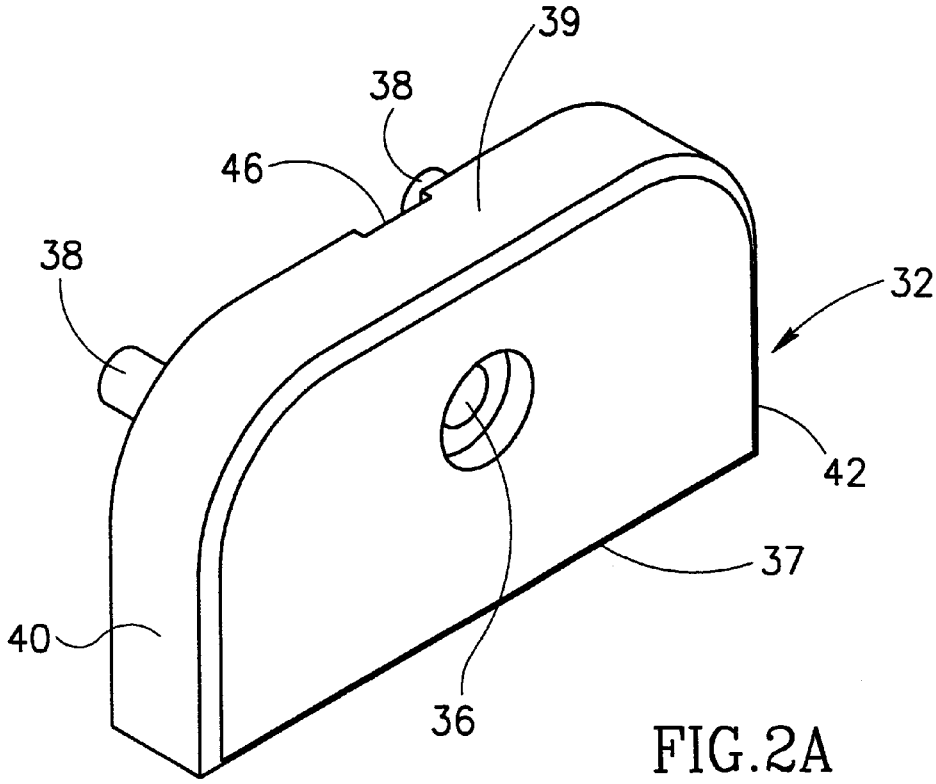
FIG. 2A is a obstructing member.

FIG. 2A shows in some more detail the construction of the obstructing member 32 which is a block-like member comprising a hole 36 for a screw fastener for attaching the obstructing member to side wall 34 of the drawer, and two studs 38 for press-fit engagement with corresponding apertures formed in side wall 34 so as to ensure fixed positioning of obstructing member 32 to side wall 34.

Obstructing member 32 comprises an obstruction wall 40 and an auxiliary obstruction wall 42, both of which being essentially parallel with one another and extending essentially vertical when fixed to drawer 24.

Obstructing member 32 further comprises a recess 46 to assist in removal of the stopping member from the drawer by inserting a suitable tool, e.g. a screw driver. Recess 46 may extend the entire height of member 32.

For reasons to be hereinafter explained, the top corners of the obstructing member 32 are rounded. Furthermore, the distance between aperture 36 and a bottom surface 37 of the device is longer than the distance between aperture 36 and a top surface 39 of the device, for reasons to become clear hereinafter.

Figure 2B:
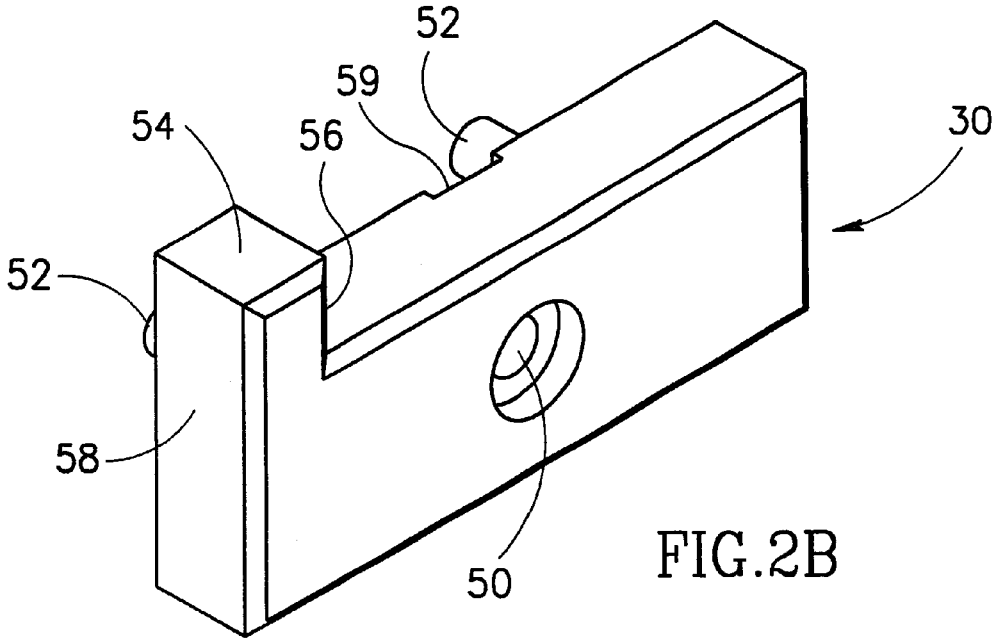
FIG. 2B is a stopping member.

Referring now to FIG. 2B, there is seen a stopping member 30 which similar to constructing member 32 comprises an opening 50 and two studs 52 for fixedly securing the stopping member 30 to side wall 31 of housing 22. Projecting from a top surface of the stopping member 30 is a upright projection 54 having a stopping wall portion 56 and an auxiliary stopping wall portion 58 parallel with one another and when fixedly positioned on wall 31 of housing 22, extend essentially vertically. Stopping member 30 is also provided with a recess 59.

FIG. 3A illustrates the respective positioning of the stopping member 30 and the obstructing member 32 fixed to the respective side walls of housing 22 and drawer 24 in the closed position of the drawer. It is seen that stopping member 30 is fixed to side wall 31 by a fastener 60 and two studs 52 and has a bottom surface thereof flush with rail 26.

As can best be seen in FIG. 3B, a bottom edge 64 of obstruction wall 40 extends below a top edge 66 of stopping wall 56, the difference designated by L with a horizontal distance therebetween designated W. Distance L is slightly less than the vertical tolerance of drawer 24 within housing 22 and in standard assemblies is about 3½ mm. Distance W is about 23 mm wide and corresponds with the width of a front panel 70 of drawer 24 (see FIG. 3A).

It will be appreciated that the width of upright projection 54 of stopping member 30 as well as the overall width of obstruction member 32 are determined so as to provide sufficient drawing out of the drawer before obstruction wall 40 engages with stopping wall 56 in an opening process, and in a closing process sufficient width is provided to prevent finger jamming.

Figure 4B:
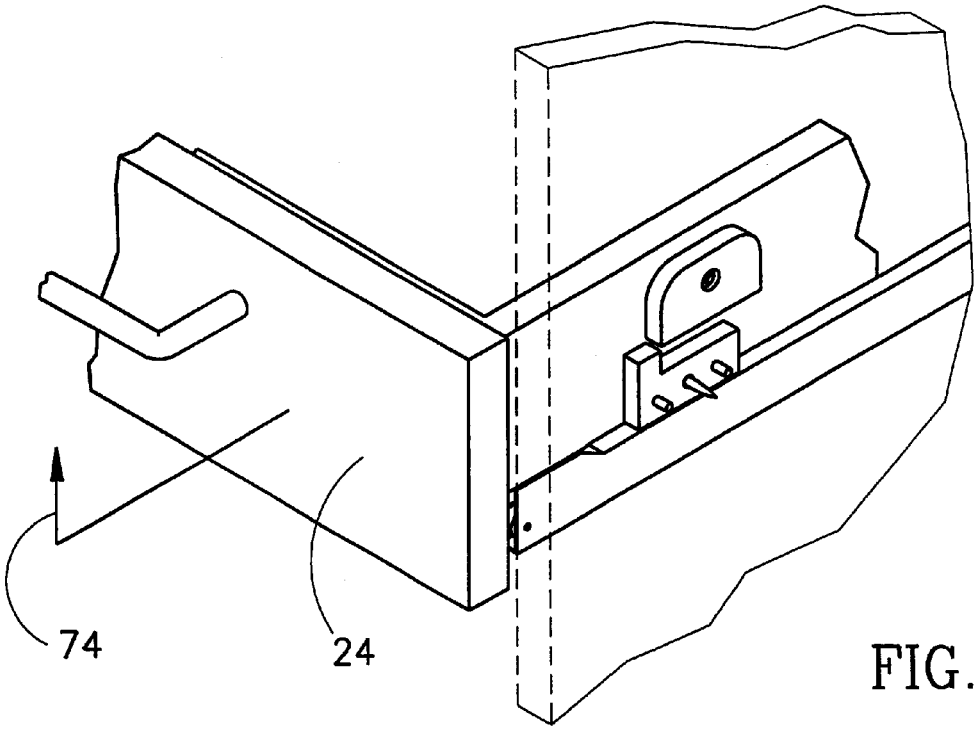
Figure 4C:
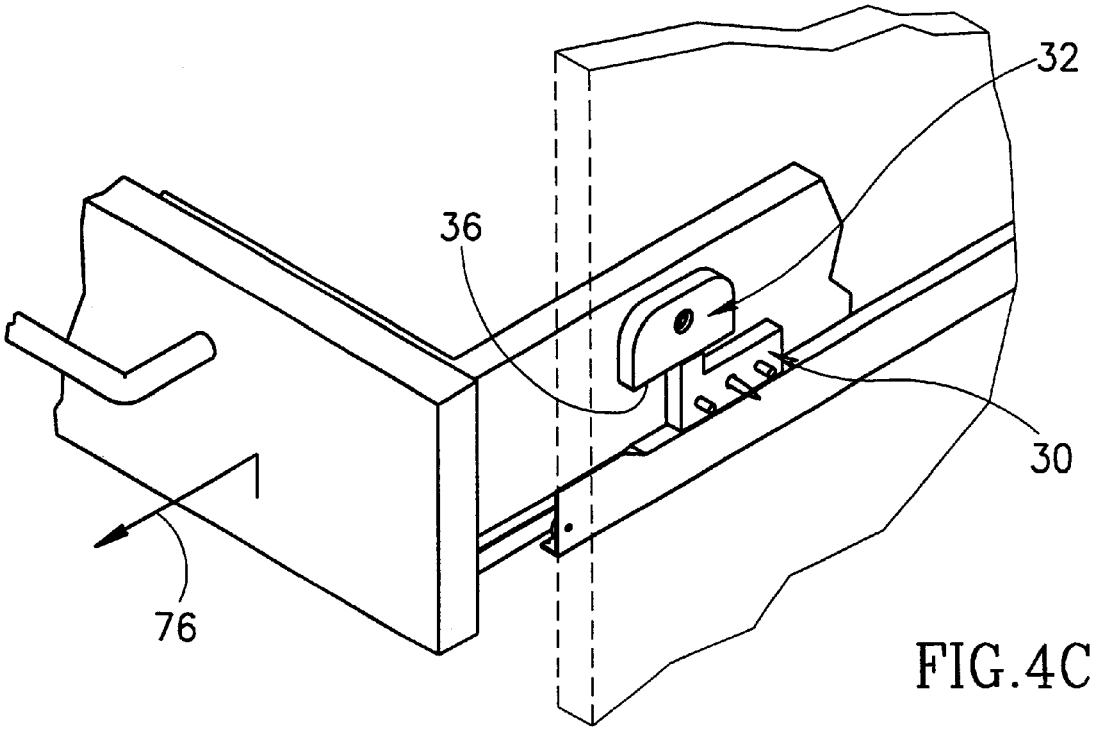

Thus, the arrangement is such that attempting to pull out drawer 24 entails engagement of obstruction wall 40 with stopping wall 56 and further withdrawal of the drawer is prevented, as seen in the position shown in FIG. 4A. Overcoming the obstruction is enabled only by slightly fitting the drawer 24 in direction of arrow 74 seen in FIG. 4B at about 3½ mm which distance falls within the vertical tolerance of a standard drawer. Upon further pulling the drawer in the direction of arrow 76 seen in FIG. 4C, the obstructing member 32 overrides the stopping member 30 and complete drawing of drawer 24 is enabled, until mating stopping members (not shown) of respective rails 26 and 28 engage with one another to prevent unintentional removal of the drawer, as known per se.

It will be appreciated that the combined operation required for opening a drawer, i.e. pulling and lifting is not a skill which a young child is competent of, and thus it is appreciated that a child will not succeed in opening a drawer in which the safety device is installed.

Figure 4D:
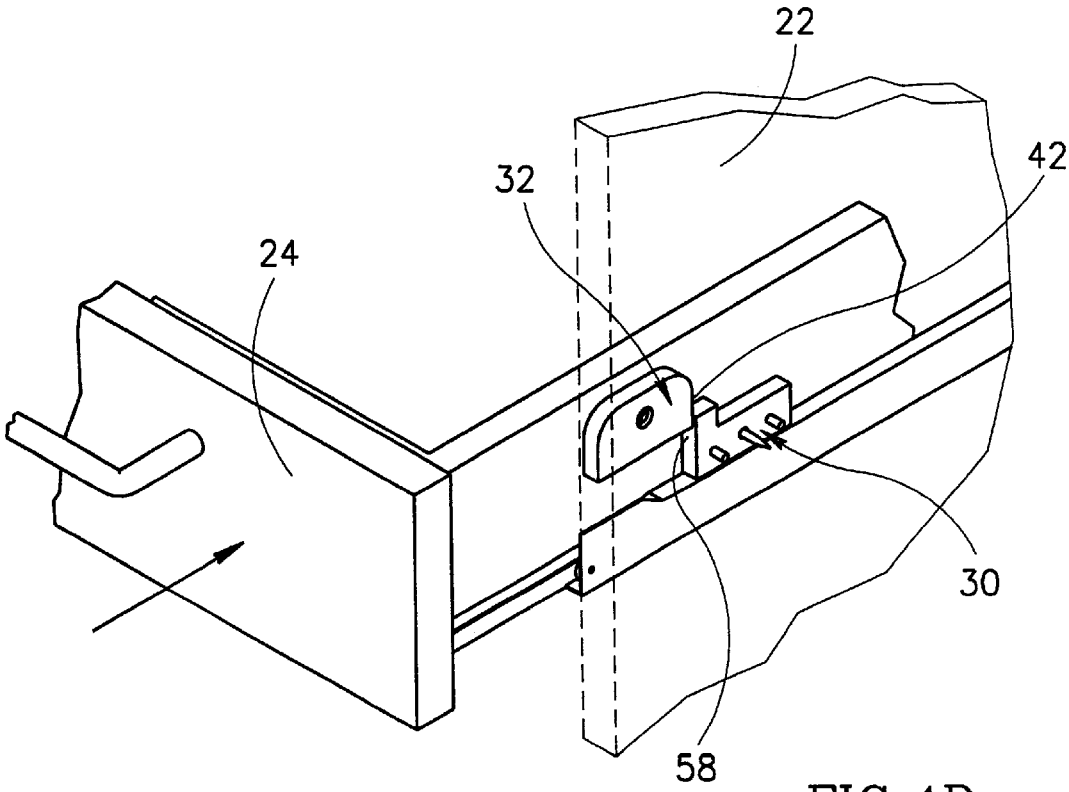

Finger injury caused by jamming in a drawer closing process is avoided in the manner as seen in FIG. 4D wherein upon inserting drawer 24 the auxiliary obstruction wall 42 of obstructing member 32 engages the auxiliary stopping wall 58 of stopping member 30, preventing the final stage of closing the drawer. Overcoming the obstruction is carried out by lifting the front of drawer 24 so that the obstructing member 32 overrides the stopping member 30. Here again, it will be appreciated that a young child is not competent of such a combined operation.

Figure 5:
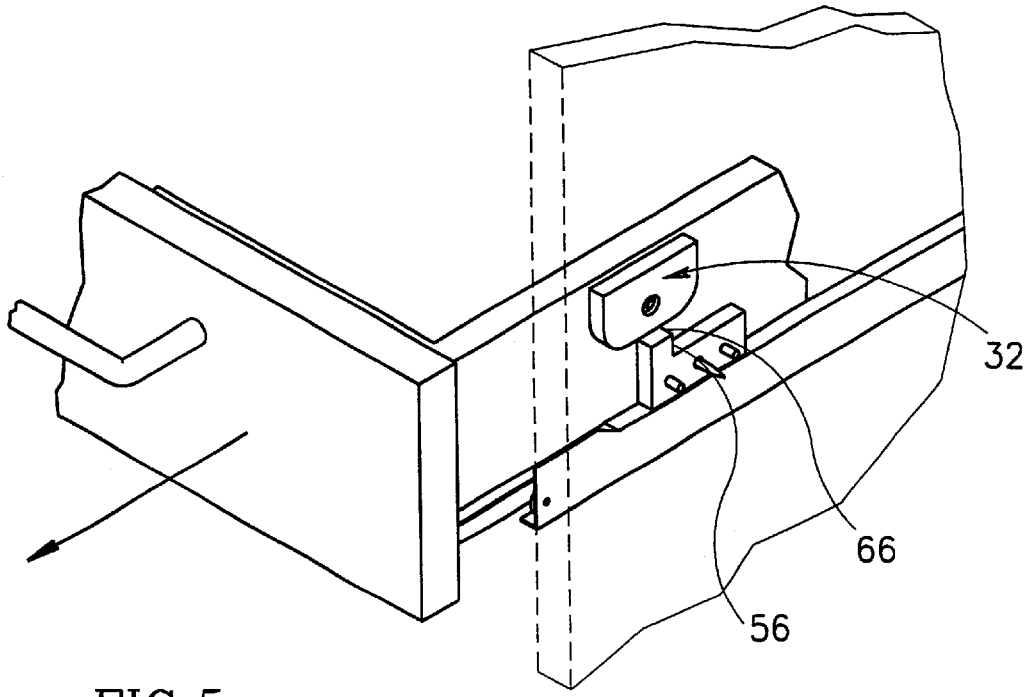
FIG. 5 illustrates how the device in accordance with the present invention may be retained within the sliding assembly without constituting an obstacle for temporary disablement of the safety device.

In FIG. 5, the safety device is illustrated in a temporary unoperable position, e.g. when a child has grown up and it is no longer desired to obstruct sliding of the drawer until, another young child makes use of the sliding assembly (e.g. chest of drawers).

For converting the safety device into its unabled position, the obstructing member 32 is rotated by 180° about its fastener, whereby the top edge 66 of the stopping wall 56 extends below surface 39 of the obstructing member 32 whereby the drawer may be freely closed and opened. However, when it is desired to reactivate the safety device, then obstructing member 32 is again rotated by 180° in the position seen in the previous figures. In order to facilitate easy removal of the obstructing member 32 and the stopping member 30 (if for some reason it is desired to remove) then a screwdriver is inserted into the recesses 46 and 59 as can readily be understood.

Figure 6A:
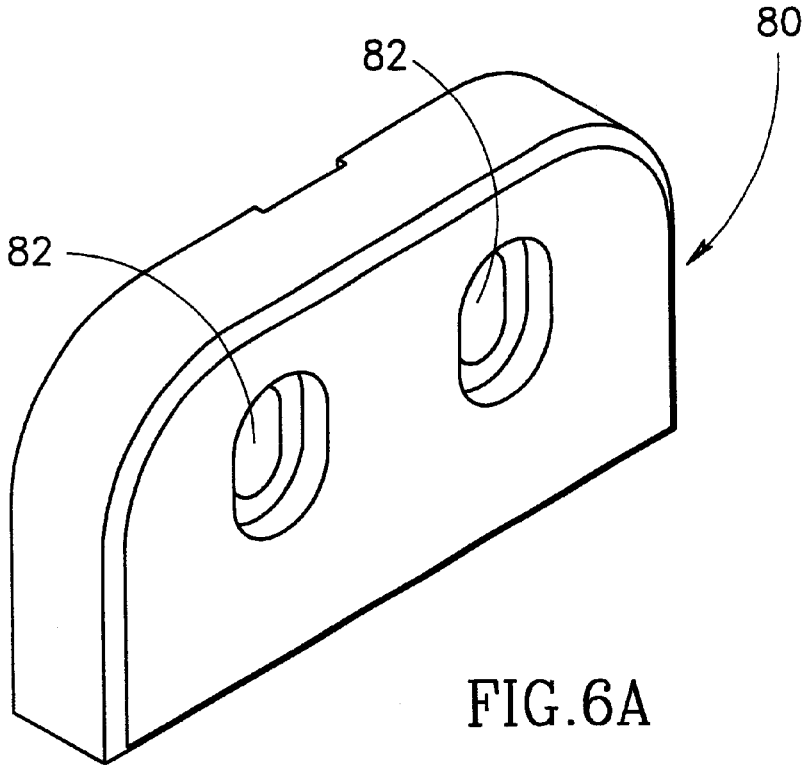
FIGS. 6A and 6B are isometric views of an obstructing member and a stopping member, respectively, in accordance with another embodiment of the present invention.

Vertical positioning of the obstructing member is of some significant importance and depends on the tolerance of the rail assembly as well as on tolerance of fixing the obstructing member to the drawer's side wall. On the other hand, horizontal positioning of the stopping member is influenced by the width of the front panel of a drawer as well as on the precise positioning of the stopping member on the side wall of the housing. Accordingly, the stopping member 80 seen in FIG. 6A comprises two essentially vertical slots 82 allowing for some vertical adjustment wherein assembling the stopping member to the side wall of the drawer. Similarly, as seen in FIG. 6B, the stopping member 86 comprises two horizontal slots 88 allowing for some horizontal tolerance in assembly.

Figure 6B:
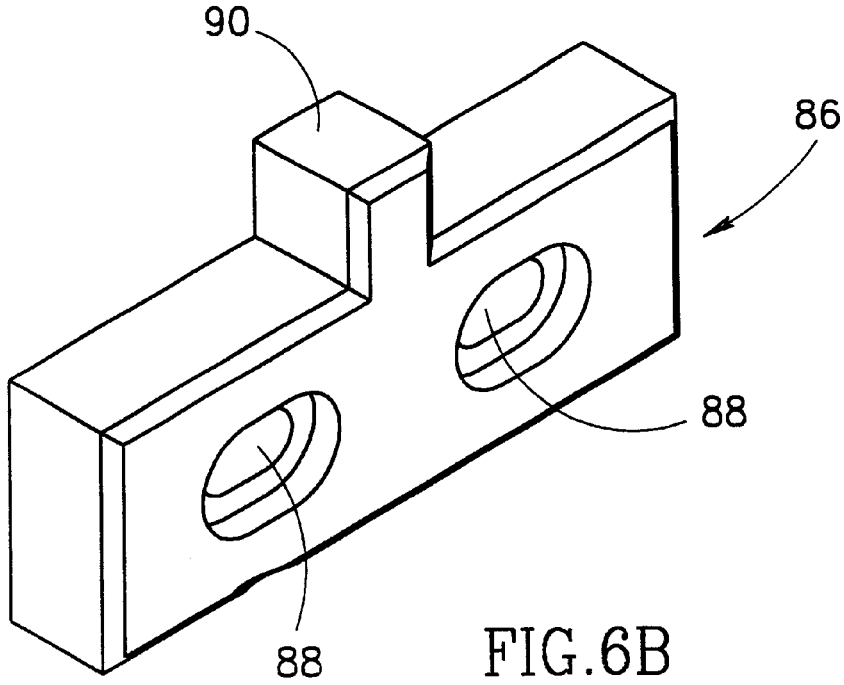

As can further be seen in FIG. 6B, the upward projection 90 extends essentially at the center of the stopping member 86 rather than at one of its sides. This arrangement may be suitable for different types of sliding assemblies.

Figure 7A:
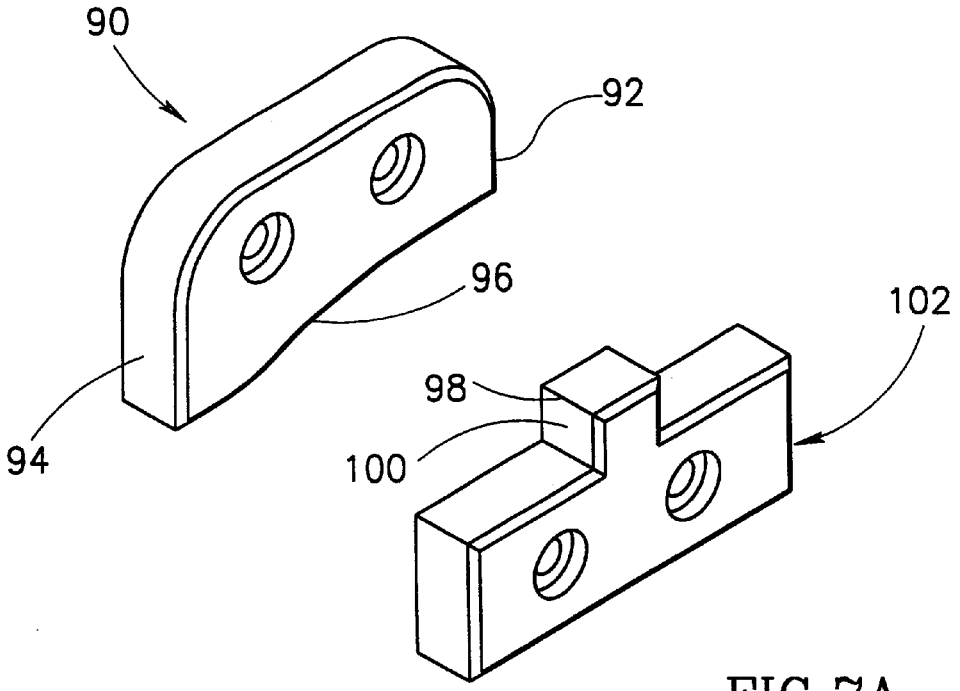
FIGS. 7A and 7B are perspective views of different embodiments of safety devices according to the present invention.

Other embodiments of safety devices in accordance with the present invention are seen in FIG. 7. Obstruction member 90 of FIG. 7A comprises a first side wall 92 and a second side wall 94 whereby the obstruction wall is constituted by the curved bottom surface 96 of the obstructing member 90 and whereby side wall 94 constitutes the auxiliary obstruction wall. The arrangement is such that in assembly, side wall 92 extends above a top edge 98 of auxiliary stopping wall 100 of stopping member 102. In accordance with this embodiment, opening the drawer is possible only by lifting it as described in connection with the procedure of FIG. 4. However, in closing the drawer there is no need to raise the front end of the drawer as the obstruction wall 96 slides over edge 98 of the stopping member 102.

Figure 7B:
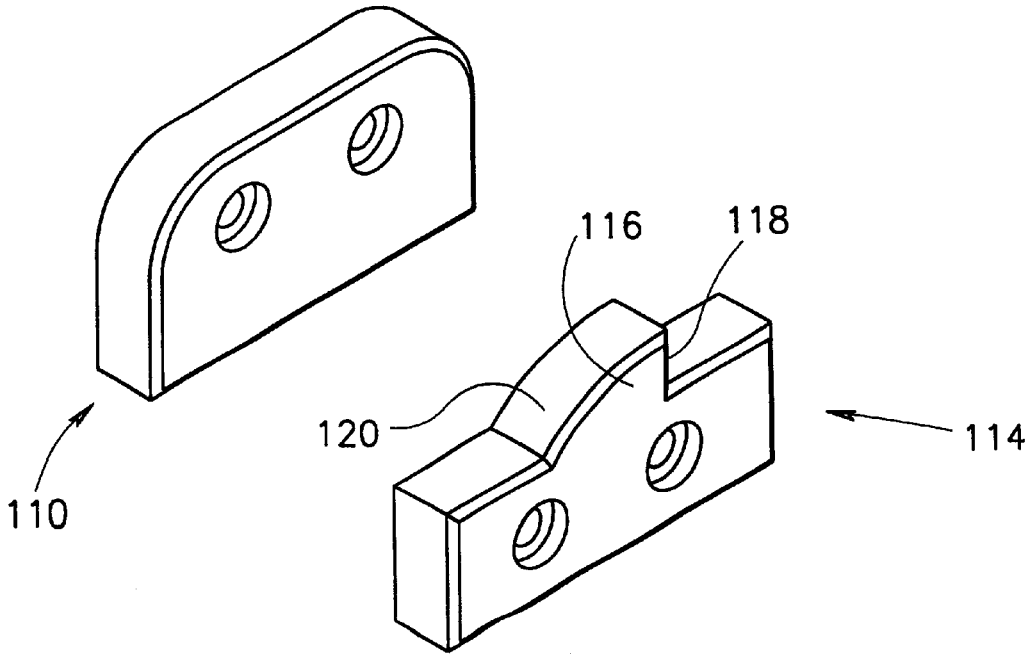

In FIG. 7B, a different arrangement of safety device is illustrated wherein obstructing member 110 is essentially similar to the obstracting member seen in FIG. 2A, while stopping member 114 is formed with an upward projecting portion 116 having an essentially vertical stopping wall 118 and a curved auxiliary stopping wall 120.

The safety device of FIG. 7B prevents uncontrolled opening of the drawer on the one hand, but enables closing the drawer without having to lift it, similar to the embodiment of FIG. 7A.

It will be appreciated that inverting the direction of sloping walls will result in obtaining different functions of the safety device, namely, enabling uninterrupted opening of the drawer and requiring combined operation in closing of a drawer.

Figure 8A:
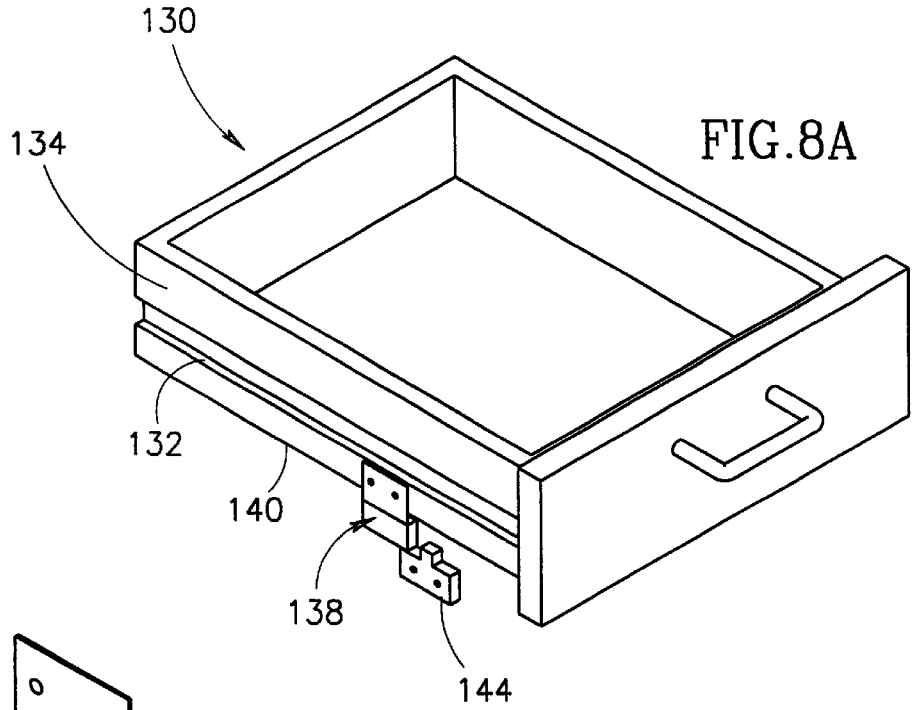
FIGS. 8A and 8B are perspective views of different drawers illustrating how different embodiments of the device may be used.

FIG. 8A illustrates a different type of drawer generally designated 130 formed with a longitudinal side groove 132 for sliding engagement with a corresponding rail fixedly attached within a side wall of the housing (not shown). As readily understood, the interstice between the side wall 134 of drawer 130 and the corresponding side wall of the housing is very narrow and at times the side walls are in fact flush with one another. For that purpose, a specially designed obstructing member 138 is provided and extends below a bottom edge 140 of drawer 130 and is adapted for engagement with a stopping member 144 similar to the embodiment seen in FIG. 7A.

Figure 8C:
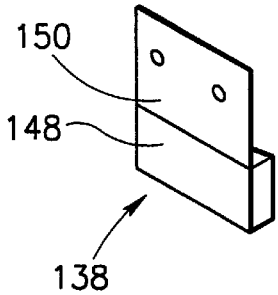
FIGS. 8C and 8D are perspective views of obstructing members in accordance with other embodiments of the present invention for use in conjunction with special types of drawers, as in FIGS. 8A and 8B.
Figure 8B:
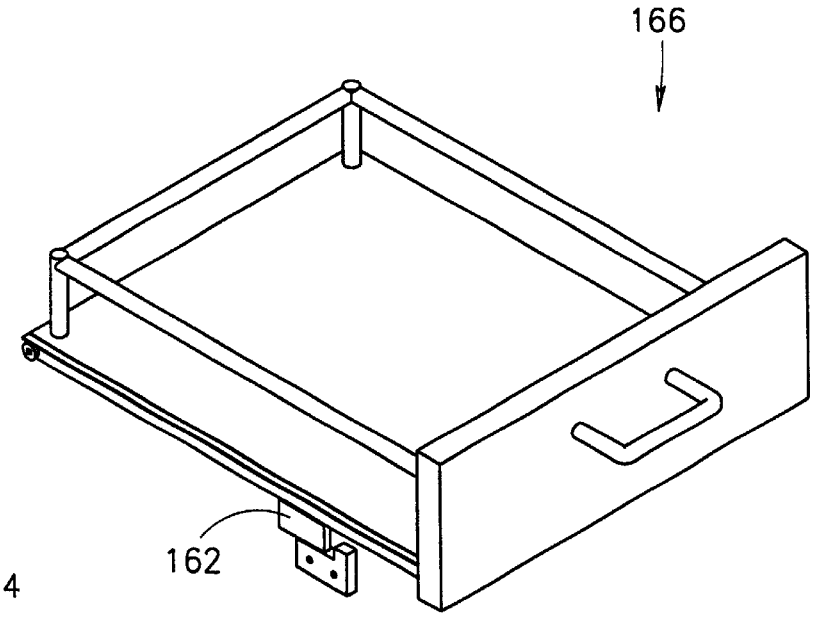
Figure 8D:
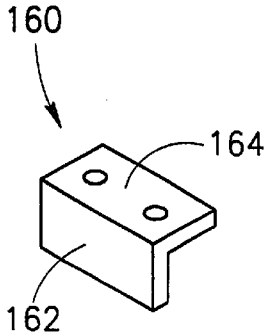

The obstructing member 138 which is better seen in FIG. 8C, comprises an obstructing component 148 and an essentially flat and thin connecting portion 150 for connecting to side wall 134 of drawer 130 by screws (not seen) as apparent from FIG. 8A. FIG. 8D illustrates an alternative obstructing member 160 having an essentially L-like shape comprising an obstructing portion 162 and a connecting portion 164 for attachment to a bottom surface of a shelf-like drawer as seen for example in FIG. 8B wherein side walls are not available, whereby the obstructing member 162 is attached at a bottom surface of the drawer 166.

Figure 9:
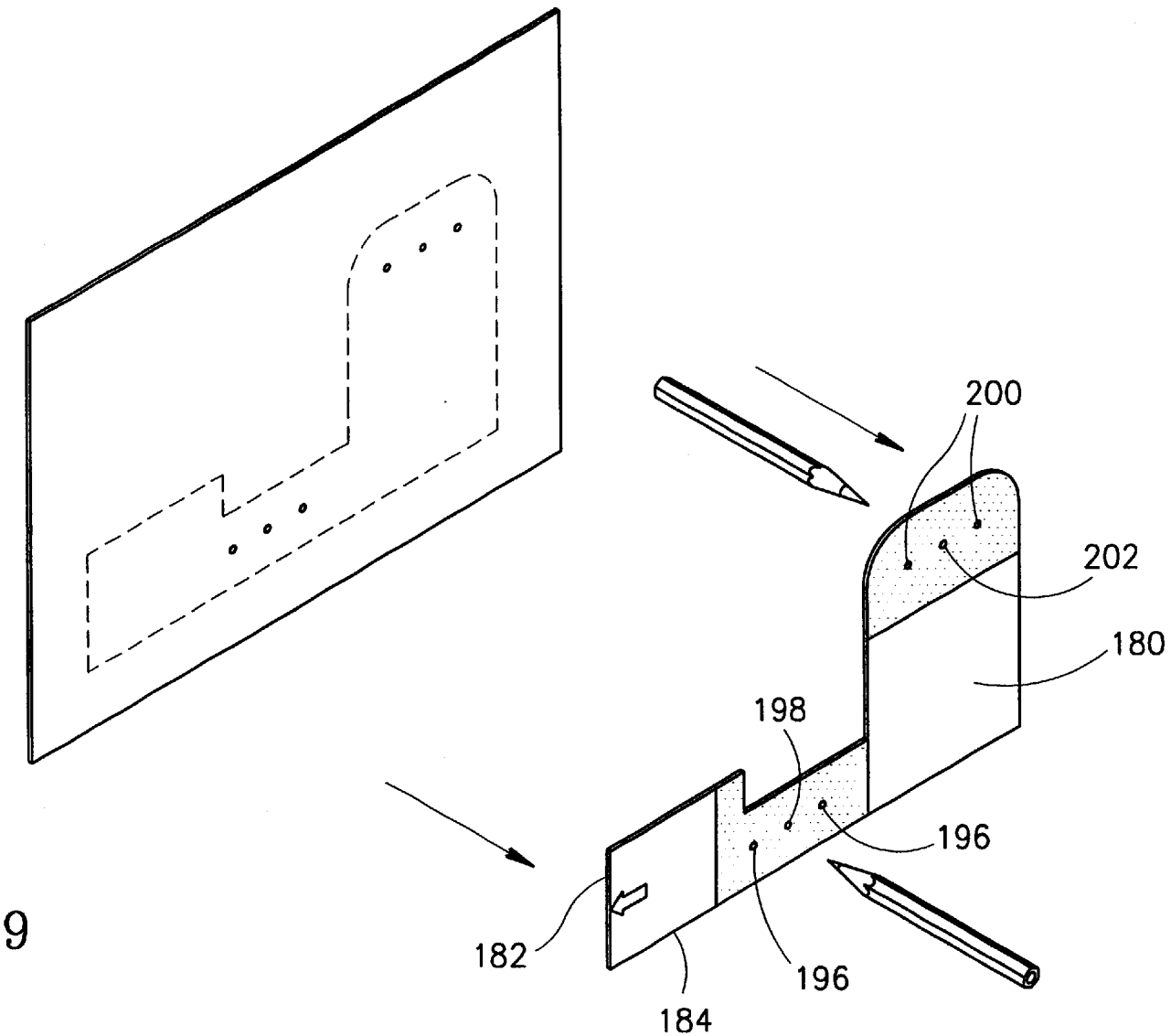
FIG. 9 is a perspective view of a portioning jig for correct positioning of the safety device of the invention.

The safety device in accordance with the present invention may be sold as a kit for attachment to a sliding assembly. For that purpose, there may be provided a positioning jig 180 as seen in FIG. 9, made for example of cardboard or the like and which is so dimensioned and shaped in order to facilitate correct positioning and assembly of the stopping member and obstructing member on the side wall of the respective housing and drawer. Positioning jig 180 has a front edge 182 which in use should be aligned with the front edge of the respective housing or drawer and with its bottom edge 184 positioned flush on top of the rail of the respective drawer or housing. Carrying out these instructions, will locate the true position for markings 196 and 198 corresponding with locations in which bores are to be drilled for receiving studs 52 of stopping member 30 and a fastener. Similarly, marking of indications 200 and 202 on the side wall of a drawer will identify the correct location for drilling holes for receiving studs 38 and a fastener extending through hole 36 for securing the obstructing member 42. The shaded areas on the positioning jig represent the position of the respective stopping member and obstructing member.

By the preferred embodiments having been shown and described with reference to the accompanying drawings, it is to be understood that it is not intended thereby to limit the disclosure, but rather it is intended to cover all modifications and arrangements which fall within the scope and the spirit of the present invention, mutatis mutandis.

For example, a variety of combinations of different shapes and dimensions of obstructing members and stopping members may be used for obtaining different safety parameters. It will also be appreciated that the stopping member may be designed as a block member without the upright projection, where the block's side walls serve as the stopping wall and auxiliary stopping wall.

What is claimed is:

1. A safety apparatus for limiting movement of drawers the safety apparatus comprising:

a sliding assembly, the sliding assembly including a housing, at least one drawer mounted within the housing, and a rail assembly for slidably moving the drawer between open and closed positions, the drawer having a predetermined degree of vertical tolerance within the housing; and a safety device including a stopping member and an obstructing member, the stopping member affixed to a vertical side wall of the housing adjacent a front edge thereof, and the obstructing member affixed to a corresponding vertical side wall of the drawer adjacent a front edge thereof, the stopping member being formed with a stopper wall, and the obstructing member being formed with a corresponding obstruction wall;

wherein when the drawer is in the closed position, a bottom edge of the obstruction wall extends below a top edge of the stopping wall and a vertical distance between the bottom edge of the obstruction wall and the top edge of the stopper wall is less than the vertical tolerance, whereby to pull out the drawer, the drawer must first be lifted so that the obstructing member overrides the stopping member.

2. The safety apparatus according to claim 1, wherein, when the drawer is in the closed position, the top edge of the stopper wall is closer to the front edge of the drawer than the bottom edge of the obstruction wall.

3. The safety apparatus according to claim 2, wherein the stopper wall is essentially parallel to the obstruction wall.

4. The safety apparatus according to claim 3, wherein the stopper wall and the obstruction wall are essentially vertical.

5. The safety apparatus according to claim 2, wherein the stopping member is formed with an auxiliary stopper wall parallel to the stopper wall and the obstructing member is formed with a corresponding auxiliary obstruction wall parallel to the obstruction wall; wherein when the drawer is in the open position, the bottom edge of the auxiliary obstruction wall extends below a top edge of the auxiliary stopping wall and an auxiliary vertical distance between a bottom edge of the auxiliary obstruction wall and a top edge of the auxiliary stopper wall is less than the vertical tolerance.

6. The safety apparatus according to claim 5, wherein the auxiliary stopper wall and the auxiliary obstruction wall are essentially vertical.

7. The safety apparatus according to claim 5, wherein at least one of the stopper wall and the corresponding obstruction wall and a corresponding one or both of the auxiliary stopper wall and the auxiliary obstruction wall are sloped.

8. The safety apparatus according to claim 2, wherein when the drawer is in the closed position, a horizontal distance between the bottom edge of the obstruction wall and the top edge of the stopping wall is equal to a thickness of a front wall of the drawer.

9. The safety apparatus according to claim 1, wherein an interstice exists between the side wall of the drawer and the side wall of the housing, whereby a width of the obstructing member and a width of the stopping member extend within the interstice.

10. The safety apparatus according to claim 1, wherein the side wall of the drawer is essentially flush with the side wall of the housing, whereby the obstruction wall is positioned below a bottom side edge of the drawer.

11. The safety apparatus according to claim 1, wherein the drawer becomes freely slidable within the housing by rotating at least one of the stopping member and the obstructing member about a respective fastener fixing each of the stopping member and the obstructing member to the respective side wall of the housing and the drawer.

12. The safety apparatus according to claim 1, wherein at least one of the stopping member and the obstructing member are formed with at least one of a vertical slot and a horizontal slot to allow accurate positioning of the safety device by a fastener.

13. The safety apparatus according to claim 1 further comprising a positioning jig for correct positioning of the stopping member and the obstructing member on the respective side walls of the drawer and the housing.

14. The safety apparatus according to claim 1, wherein the safety device comprises two safety devices, the obstructing members and stopping members of each safety device being mounted on opposite sides of the drawer and the housing.

* * * * *